US008662770B2

(12) United States Patent
Asada et al.

(10) Patent No.: US 8,662,770 B2
(45) Date of Patent: Mar. 4, 2014

(54) IMAGE RECORDING APPARATUS

(75) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 303 days.

(21) Appl. No.: 13/027,451

(22) Filed: Feb. 15, 2011

(65) Prior Publication Data

US 2011/0222948 A1 Sep. 15, 2011

(30) Foreign Application Priority Data

Mar. 15, 2010 (JP) ..... 2010-056976
Mar. 15, 2010 (JP) ..... 2010-057041

(51) Int. Cl.
*B41J 13/00* (2006.01)

(52) U.S. Cl.
USPC ..... 400/578; 271/9.09; 271/9.01

(58) Field of Classification Search
USPC ..... 271/248, 9.09, 9.12, 9.13; 399/392; 400/578, 691, 693, 610.1
See application file for complete search history.

(56) References Cited

U.S. PATENT DOCUMENTS 5,332,323 A * 7/1994 Murai et al. ..... 400/605
7,062,196 B2 * 6/2006 Nanno ..... 399/107
7,581,806 B2 * 9/2009 Niioka ..... 347/19
7,912,418 B2 * 3/2011 Hattori et al. ..... 399/405
2005/0068360 A1 3/2005 Hess et al.

FOREIGN PATENT DOCUMENTS

JP 02028444 A * 1/1990
JP 2001-039557 A 2/2001
JP 2005-104150 A 4/2005
JP 2006-091947 A 4/2006

* cited by examiner

*Primary Examiner* — Matthew G Marini
(74) *Attorney, Agent, or Firm* — Baker Botts L.L.P.

(57) ABSTRACT

Image recording apparatus including manual medium insertion tray manually loaded with recording medium, the tray being connected to rear end portion of housing such that the tray is pivotable in vertical direction about horizontal axis of first hinge portion located below first hinge portion provided for image reading device, between its operative position in which the second recording medium is fed to feeding path leading to image recording device, and its retracted position, the tray placed in the operative position having upwardly inclined posture extending outwardly from the rear end portion of the housing, while the tray placed in the retracted position having posture extending generally downwards into accommodating space formed within the housing and on rear side of U-turn sheet transfer path connecting the sheet supply cassette and the feeding path, the tray being pivotable between the operative and retracted positions through rear opening formed in the housing.

17 Claims, 10 Drawing Sheets

IMAGE RECORDING APPARATUS

CROSS REFERENCE TO RELATED APPLICATION

The present application claims the priority from Japanese Patent Applications Nos. 2010-056976 and 057041 both filed Mar. 15, 2010, the disclosure of which is herein incorporated by reference in its entirety.

BACKGROUND OF THE INVENTION

1. Field of the Invention

The present invention relates generally to an image recording apparatus capable of recording or printing characters and other image data on a plurality of kinds of recording media, and more particularly to such an image recording apparatus of the type provided with a manual medium insertion tray on a rear side of its main body housing.

2. Description of Related Art

There is known an image recording apparatus provided with a manual medium insertion tray disposed in its main body housing and constructed to be manually loaded with a recording medium such as paper sheets. This image recording apparatus is of a single-function type such as a printer, a copier and a facsimile device of an ink-jet or laser type, or of a multi-function type having a printing function, a copying function, a scanning function and a facsimile transmission-reception function.

One type of an image recording apparatus constructed as described above has an image reading device disposed in an upper part of its main body housing and configured to read image data on an original, a sheet supply cassette disposed in a lower part of the main body housing and constructed to accommodate a first recording medium in the form of paper sheets, for example, a recording device disposed above the medium supply cassette and configured to record an image according to the image data on the first recording medium fed from the medium supply cassette through a U-turn path, and a medium ejecting portion disposed on a front side of the main body housing and constructed to eject the first recording medium received from the recording device. This type of image recording apparatus further has a first manual medium insertion tray disposed on a rear side of the main body housing such that the first manual medium insertion tray is inclined with its proximal end located below its distal end. A second recording medium is manually inserted into the first manual medium insertion tray, subjected to a recording operation of the recording device and ejected from the medium ejecting portion on the front side.

Another type of image recording apparatus has an arrangement similar to that of the image recording apparatus described just above, and further has a medium inlet which is disposed on the front side of the main body housing and through which a second manual medium insertion tray manually loaded with a third recording medium in the form of a DVD, for example, is fed toward and through the recording device so that an image is recorded on a surface of the third recording medium by the recording device. The second manual medium insertion tray is returned back to the medium inlet after the recording operation of the recording device on the third recording medium.

SUMMARY OF THE INVENTION

However, the both types of known image recording apparatus described above have a problem of a large floor space required for its installation due to the first manual medium insertion tray which is disposed with fixed position and posture relative to the main body housing and which projects a relatively large distance from the rear side of the main body housing even while the first manual medium insertion tray is not used.

Also known is an image recording apparatus of the type having the first manual medium insertion tray, which is constructed to solve the problem described above, namely, constructed such that the first manual medium insertion tray is pivotable or foldable upwards about a pivot axis (hinged portion) at the lower proximal end, from the above-indicated inclined position to an upright position in which the first manual medium insertion tray is generally parallel to the rear surface of the main body portion.

On the other hand, the first manual medium insertion tray is required, during its use, to have a large length in the direction of supply or insertion of the second recording medium from the distal end toward the proximal end (from the free end toward the pivot axis end) of the tray, for stable insertion of the recording medium. In view of this requirement, it is proposed to provide the first manual medium insertion tray with an auxiliary tray which is linearly movable or foldable relative to the first manual medium insertion tray. The distal end portion of this auxiliary tray in its extended or non-folded posture is advantageously visible from the operator of the image recording apparatus standing in front of the apparatus, facilitating the manual insertion of the desired second recording medium into the first manual medium insertion tray.

The first manual medium insertion tray of the type which is pivoted or folded upwards to the upright position while the tray is not in use requires an accommodation recess to accommodate the tray in its upright position, which accommodation recess is formed in the rear surface of the main body housing. This accommodation recess is required to have a vertical dimension from the pivot axis of the tray, which is large enough to accommodate the tray in its upright position. The pivot axis of the first manual medium insertion tray is required to be located at a relatively high position, since the second recording medium must be fed substantially horizontally from the first manual medium insertion tray to the recording device which is located at a relatively high position within the main body housing. Accordingly, a rear portion of the main body housing in which the above-indicated accommodation recess is formed is required to have a large vertical dimension above the pivot axis of the first manual insertion tray, There is also a requirement for compact construction of the image recording apparatus with a reduced height dimension of the main body housing. The image recording apparatus of the type having the image reading device disposed in the upper part of the main body housing is usually constructed such that the image reading device is hinged to the main body housing so as to be opened and closed with respect to the upper surface of the housing, for easy maintenance of the apparatus. In this construction, it is actually difficult to form the above-indicated accommodation recess so as to extend above the image reading device. In this respect, the rear portion of the main body housing in which the accommodation recess is formed tends to have a large vertical dimension, resulting in a large bulk of the image recording apparatus.

The present invention was made in view of the background art described above. It is therefore a first object of the present invention to provide a compact image recording apparatus having a reduced vertical dimension of its main body housing and comprising a first manual medium insertion tray having a sufficient length in the direction of insertion of a second recording medium used in addition to a first recording medium supplied from a sheet supply cassette. A second object of the invention is to provide an image recording apparatus having a reduced vertical dimension of its main body housing and having a first manual medium insertion tray that is easily visible by the operator during its use. An optional object of the invention is to provide such an image recording apparatus having a medium inlet which is disposed on the front side of the main body housing and through which a second manual medium insertion tray manually loaded with a third recording medium such as a DVD is fed along the recording device so that image data are recorded on a surface of the third recording medium by the recording device and so that the second manual medium insertion tray is returned back to the medium inlet after the recording operation of the recording device on the third recording medium.

The first and second objects indicated above can be achieved according to a first aspect of this invention, which provides an image recording apparatus comprising: a main body housing having a front opening formed on a front side thereof, and a tray accommodating space formed in a rear end portion thereof an image recording device disposed in the main body housing and configured to record images on recording media; a feeding path which is formed in the main body housing and along which each of the recording media is fed through the image recording device; the main body housing being configured to permit a sheet supply cassette to be disposed below the image recording device such that the sheet supply cassette is movable into and out of the main body housing through the front opening, the sheet supply cassette being configured to accommodate a stack of sheets as a first recording medium; a first feeding mechanism configured to feed the sheets of the first recording medium one after another from the sheet supply cassette; a U-turn sheet transfer path formed so as to extend generally upwards from an end of the sheet supply cassette on a rear side of the main body housing, to transfer the sheets of the first recording medium fed by the first feeding mechanism, to the feeding path along which the sheets are fed through the image recording device and ejected through the front opening of the main body housing, by the first feeding mechanism; a first hinge portion disposed at the rear end portion of the main body housing; and a first manual medium insertion tray manually loaded with a second recording medium and connected to the rear end portion of the main body housing such that the first manual medium insertion tray is pivotable in a vertical direction about a horizontally extending axis of the first hinge portion, between an operative position thereof in which the second recording medium is fed to the feeding path, and a retracted position thereof in which the second recording medium is not fed to the feeding path, the first manual medium insertion tray placed in the operative position having an upwardly inclined posture extending outwardly from the rear end portion of the main body housing, while the first manual medium insertion tray placed in the retracted position having a posture extending generally downwards in the tray accommodating space formed within the main body housing and on a rear side of the U-turn sheet transfer path, the main body housing further having on its rear side a rear opening through which the first manual medium insertion tray is pivotable to the retracted position.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which:

FIG. 9A is a schematic elevational view of the image recording apparatus of the fifth embodiment of FIG. 8, while

FIG. 12A is a partially cut-away perspective view of a first manual medium insertion tray provided in a sixth embodiment of this invention, while

DETAILED DESCRIPTION OF THE PREFERRED EMBODIMENTS

The preferred embodiments of this invention will be described by reference to the accompanying drawings.

Figure 1:
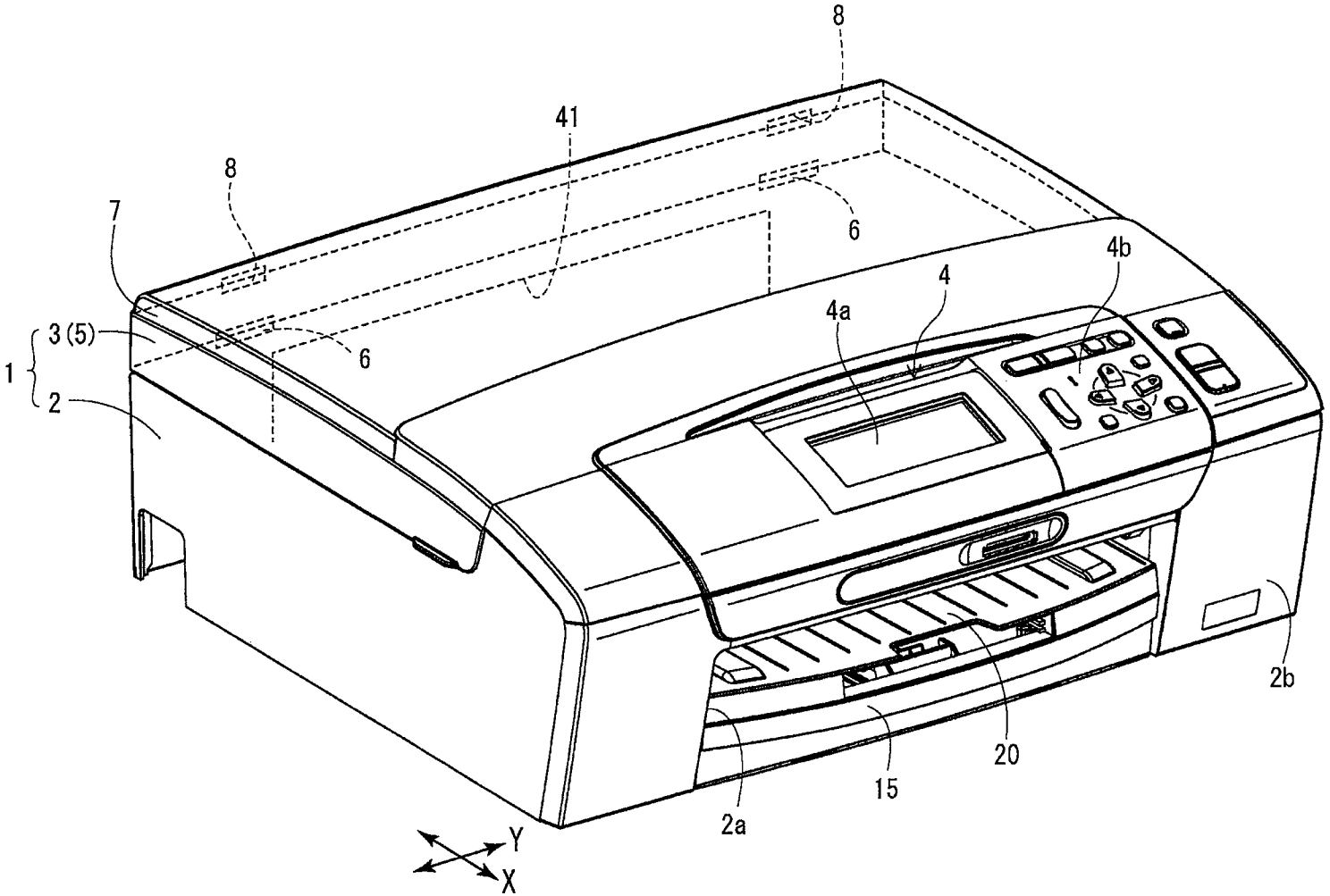
FIG. 1 is a front-side perspective view of an image recording apparatus constructed according to a first embodiment of this invention.
Figure 2:
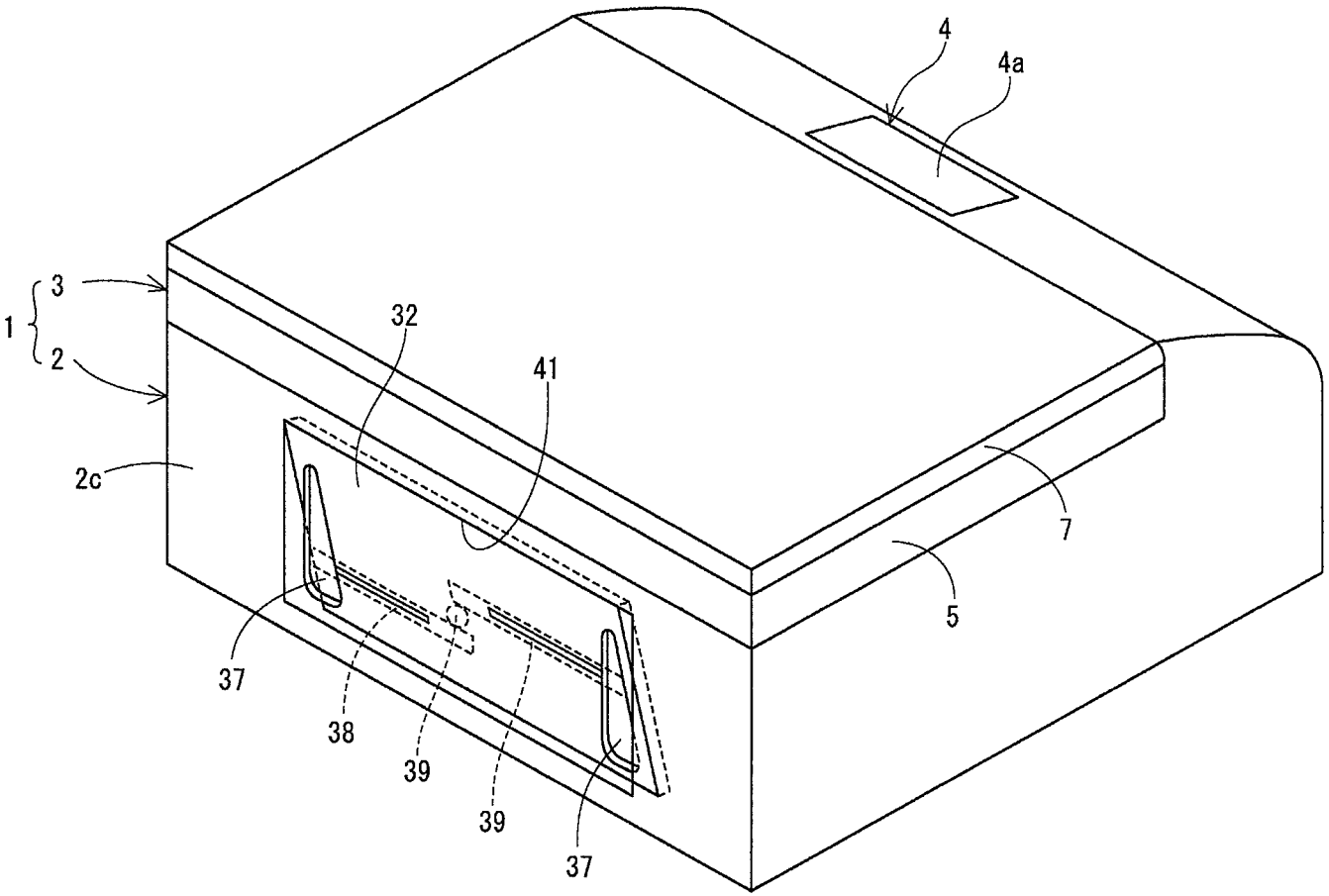
FIG. 2 is a rear-side perspective view of the image recording apparatus of FIG. 1.

Referring first to FIGS. 1-3, there is shown an image recording apparatus 1 according to a first embodiment of this invention in the form of a multi-function device (MFD) having a recording or printing function, a copying function, a scanning or image reading function and a facsimile transmission-reception function. As shown in the perspective views of FIGS. 1 and 2, the image recording apparatus 1 has a main body housing 2 which is an injection molding of a synthetic resin.

On the top surface of the main body housing 2, an upper unit 3 which is also an injection molding of a synthetic resin is connected to a rear end portion of the main body housing 2 pivotally about a second hinge portion 6, such that the upper unit 3 can be manually opened and closed relative to the top surface of the main body housing 2 in the vertical direction, that is, pivotable about the horizontally extending pivot axis of the second hinge portion 6. The main body housing 2 has a front opening 2*a* formed in its front surface, which is opposed to the rear surface adjacent to which the second hinge portion 6 is disposed as a pivot axis of the upper unit 3. On a front portion of the top surface of the main body housing 2, there is disposed an operator's control panel portion 4 having a display panel 4*a* and an array of control switches and keys.

The upper unit 3 incorporates an image reading device 5 operable to perform the copying and facsimile transmission functions. The image reading device 5 includes, a glass plate on which an original used for the copying or facsimile transmission function is placed, and a contact-type image sensor (CIS) which is disposed under the glass plate to read an image or images on the original. The upper unit 3 includes an original covering member 7 provided to cover the glass plate and press the original against the glass plate. The contact-type image sensor is reciprocable along a guide shaft extending in a Y-direction indicated in FIG. 1. The original covering member 7 is pivotally connected at its rear end to a rear end portion of the upper unit 3 through a third hinge portion 8, such that the original covering member 7 can be manually opened and closed relative to the glass plate in the vertical direction, that is, pivotable about the horizontal pivot axis of the third hinge portion 8.

The main body housing 2 has a cartridge receptacle in its front right portion (near the front opening 2*a*) as viewed in the direction from its front side toward its rear side. The cartridge receptacle is closed at its front end by a cartridge-receptacle covering member 2*b* adjacent to the front opening 2*a*. The covering member 2*b* is manually operable to open and close the cartridge receptacle, to install and remove four ink cartridges in and from the cartridge receptacle. The four ink cartridges contain respective four colors of ink, namely, black (Bk), cyan (C), magenta (M) and yellow (Y) inks. The ink cartridges are connected to a recording or printing head 14 of an ink-jet type provided in an image recording device 12 (described below) through respective flexible ink supply tubes.

Figure 3A:
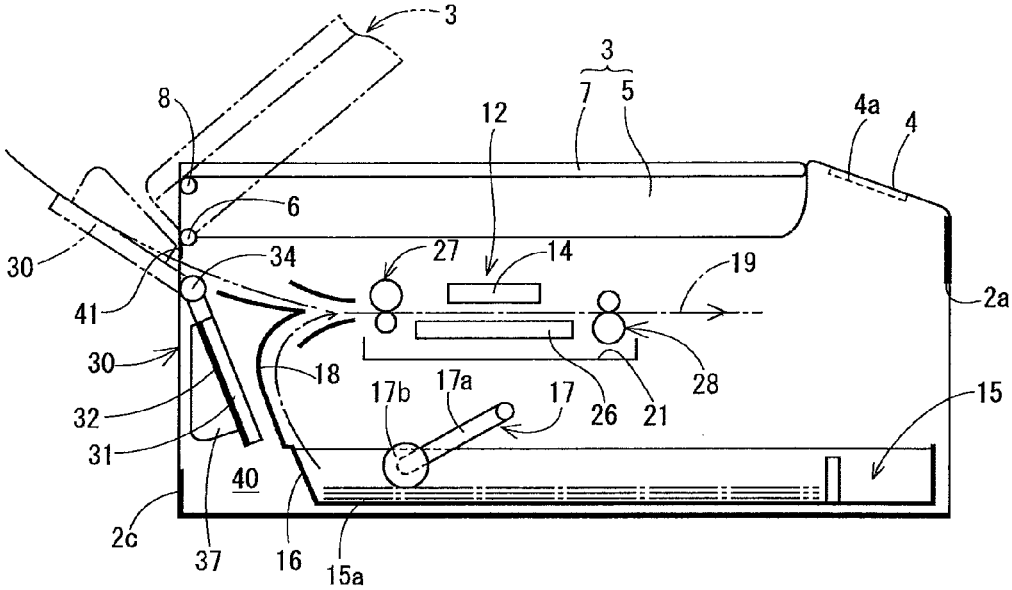
FIGS. 3A and 3B are schematic elevational views of the image recording apparatus of FIG. 1.

As shown in FIGS. 1 and 3A, a sheet supply cassette 15 is disposed in a bottom or lower portion of the main body housing 2, such that the sheet supply cassette 15 is movable through the front opening 2*a* in an X-direction also indicated in FIG. 1. The sheet supply cassette 15 accommodates a stack of a first recording medium in the form of paper sheets 15*a* of a desired size (e.g., an A4 size, a letter size, a legal size or a postcard size). An auxiliary setter is mounted on the sheet supply cassette 15 such that the auxiliary setter is movable in the X-direction on the sheet supply cassette 15, to permit setting of one sheet or a stack of small-sized recording media such as postcards.

As shown in FIG. 3A, an inclined sheet separator plate 16 is disposed at the rear end (sheet supply end) of the sheet supply cassette 15. The sheet separator plate 16 functions to separate the top sheet 15*a* from the stack of paper sheets 15*a* in the sheet supply cassette 15, and is provided on its widthwise central part (as seen in the width direction of the paper sheets) with a saw-toothed elastic separator pad for contacting the leading end of the top sheet 15*a* of the stack of paper sheets to facilitate the separation of the top sheet 15*a* from the stack.

In a lower portion of the main body housing 2 located above the sheet supply cassette 15, there is disposed a sheet feeding device 17 including a roller support arm 17*a* which is pivotable at its upper proximal end in the vertical direction. The roller support arm 17*a* carries, at its lower distal end, a sheet supply roller 17*b* which are operatively connected to and rotated by a power transmission gear mechanism connected to a rotary drive power source. This sheet supply roller 17*b* cooperates with the elastic separator pad of the inclined sheet separator 16 to separate the top sheet 15*a* from the stack in the sheet supply cassette 15 or to feed the small-sized recording medium from the auxiliary setter mounted on the sheet supply cassette 15. The first recording medium supplied from the sheet supply cassette 15 is fed to an image recording device 12 disposed above the sheet supply cassette 15, through a U-turn sheet transfer path 18 and a substantially horizontally extending feeding path 19, as shown in FIG. 3A. The U-turn path 18 is formed so as to extend generally upwards to transfer the first recording medium to the feeding path 19 from the end of the sheet supply cassette 15 on the rear side of the main body housing 2.

The image recording device 12 has a main frame 21 of box construction shown in FIG. 3A, and a first and a second guide member that are elongate plates which are supported by a pair of side plates of the main frame 21 and which extend in the Y-direction (main scanning direction). The recording head 14 of the ink-jet type of the image recording device 12 is mounted on the lower surface of a carriage which is slidably movably supported and guided by the first and second guide members disposed on respective upstream and downstream positions in the feeding direction of the first recording medium along the feeding path 19. Namely, the recording head 14 is reciprocable in the Y-axis direction with the carriage.

To reciprocate the recording head 14, the downstream second guide member is provided on its lower surface with a carriage drive motor (CR motor) to drive a timing belt connected to the recording head 14. The timing belt is disposed on the upper surface of the downstream second guide member, so as to extend in the Y-direction (main scanning direction).

The image recoding device 12 includes a planar platen 26, which is opposed to the lower surface of the recording head 14 carried by the carriage and which extends in the Y-direction.

As also shown in FIG. 3A, the image recording device 12 further includes a pair of sheet feeding (sheet registration) rollers 27 for registering the paper sheet at its leading end and feeding the paper sheet along the feeding path 19 between the recording head 14 and the platen 26. The sheet feeding rollers 27 are disposed on the upstream side of the platen 26 as seen in the feeding direction of the first recording medium in the form of the paper sheet. The pair of sheet feeding rollers 27 consist of a drive roller, and a nip roller which is driven by the drive roller and which cooperates with the drive roller to nip the paper sheet therebetween. The image recording device 12 further includes a pair of a pair of ejector rollers 28 disposed on the downstream side of the platen 16, for feeding the paper sheet fed from the image recording device 12 toward the front opening 2*a*. The pair of ejector rollers 28 consist of a drive roller, and a driven roller in the form of a spur or sprocket wheel biased against the drive roller. It will be understood that the sheet feeding device 17 and the sheet feeding rollers function as a first feeding mechanism operable to feed the first recording medium from the sheet supply cassette 15 and along the U-turn sheet transfer path and feeding path 19.

A sheet receiver tray 20 for receiving the paper sheet on which the image has been recorded by the image recording device 12 is formed integrally with the front end of the auxiliary setter of the sheet supply cassette 15. As shown in FIG. 1, the sheet receiver tray 20 is accessible through the front opening 2*a*, like the sheet supply cassette 15. The paper sheet is received by the sheet receiver tray 20 such that the surface on which the image has been recorded faces upwards.

Figure 3B:
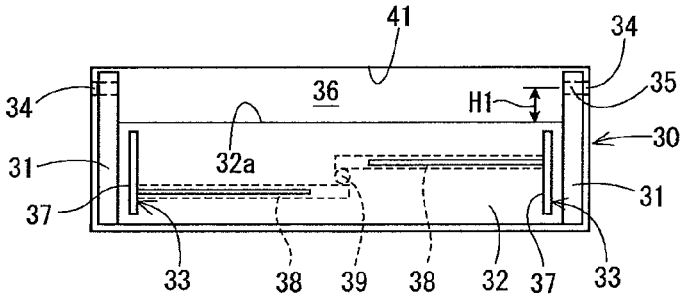

The image forming apparatus 1 has a first manual medium insertion tray 30, which will be described by reference to FIGS. 2, 3A and 3B.

As described below in detail, the first manual medium insertion tray 30 has an operative position indicated by two-dot chain line in FIG. 3A, and an inoperative or retracted position indicated by solid line in FIG. 3A. FIG. 3B shows the first manual medium insertion tray 20 placed in the retracted position. As shown in FIG. 3B, the first manual medium insertion tray 30 includes a pair of arms 31, a sheet support plate 32 connecting the arms 31, and a side guide device 33 disposed on the sheet support plate 32. The arms 31 have, at their proximal or fixed ends, a first hinge portion 34 at which the first manual medium insertion tray 30 is connected to the rear end of the main body housing 2 such that the tray 30 is pivotable about the first hinge portion 34 in the vertical direction. That is, the first hinge portion 34 provides a horizontally extending pivot axis 35 of the tray 30 about which the tray 30 is pivotable. In the operative position of the tray 30, the second recording medium in the form of a paper sheet different from the paper sheet accommodated in the sheet supply cassette 15 is manually placed on the sheet support plate 32 (not shown). The sheet support plate 32 is fixed to the arms 31 such that a gap space 36 having a dimension H1 is left between the pivot axis 35 and an end face 32*a* of the sheet support plate 32 on the side of the first hinge portion 34. The arms 31 have a larger thickness dimension than the sheet support plate 32.

The side guide device 33 includes a pair of sliders each having an abutting plate 37 slidably disposed on the sheet support plate 32 and extending in parallel to the corresponding arm 31, and a rack rod 38 extending from the abutting plate 37 perpendicularly to the abutting plate 37. The side guide device 33 further includes a pinion 39 rotatably fixed to the back surface of the sheet support plate 32 and engaging the two rack rods 38. The second recording medium in the form of the paper sheet is manually placed on the sheet support plate 32 such that the widthwise opposite side edges of the paper sheet of the second recording medium are held in abutting contact with the abutting plates 37 in the width direction of the paper sheet perpendicular to the feeding direction of the paper sheet from the tray 30. Each abutting plate 37 has a height which increases in the direction away from the pivot axis 35 (first hinge portion 34). That is, the abutting plate 37 has a larger height dimension in its end portion remote from the pivot axis 35 than in the other end portion near the pivot axis 35, so that the abutting plates 37 can be easily slidably moved by the user of the image recording apparatus 1, by finger-gripping one of the abutting plates 37 at its end portion remote from the pivot axis 35, when the paper sheet is manually placed between the abutting plates 37.

A distance between the two abutting plates 37 is changed with sliding movements of the abutting plates 37 in the width direction of the paper sheet when one of the two abutting plates 37 is finger-gripped and moved in the width direction of the paper sheet. Each slide is provided on its back surface with a lock member which is engageable with a toothed portion of the back surface of the sheet support plate 32, so that the abutting plates 32 (pair of sliders) can be held at fixed positions when the distance between the abutting plates 37 is adjusted to a desired value.

The main body housing 2 has a rear plate 2*c* having a rear opening 41 through which the first manual medium insertion tray 30 is brought into a tray accommodating space 40 located behind the U-turn sheet transfer path 18, such that the tray 30 extends generally downwards from the first hinge portion 34, with its free end having the smallest height. In the present first embodiment, the first hinge portion 34 is located at a relatively high position of the rear opening 41, and has a higher vertical position than the vertical position of the feeding path 19 and a lower vertical position that the second hinge portion 6 of the upper unit 3. The first manual medium insertion tray 30 placed in its operative position when the tray 30 is in use has an upwardly inclined posture extending outwardly from the main body housing 2 through the rear opening 41, with its free end having the largest height, as indicated by two-dot chain line in FIG. 3A, while the tray 30 placed in its inoperative or retracted position when the tray 30 is not in use has a downwardly extending posture extending generally downwards into the tray accommodating space 40, with its free end having the smallest height, as indicated by solid line in FIG. 3A. The tray 30 is pivotable between the operative and retracted positions through the rear opening 41. When the tray 30 is placed in its retracted position, the side guide device 33 is entirely accommodated in the tray accommodating space 40. To hold the tray 30 in its operative position, the main body housing 2 has a suitable stopper means engageable with the tray 30. The above-described upwardly inclined posture and downwardly extending posture of the first manual medium insertion tray 30 are defined with respect to a reference straight line which is parallel to the direction of feeding from the tray 30 into the main body housing 2 from the first hinge portion 34 toward the free end of the tray 30 and which lines on the surface of the sheet support plate 32.

The present image recording apparatus 1 constructed as described above according to the first embodiment of this invention is not required to increase the height dimension of the main body housing 2 due to the provision of the first manual medium insertion tray 30, since the main body housing 2 has the tray accommodating space 40 formed on its rear side, so that the tray 30 is pivoted into its retracted position in the tray accommodating space 40. The present image recording apparatus 1 has another advantage that the tray 30 placed in its operative position has its free end located near the top surface of the upper unit 3 and is therefore easily visible by the operator or user of the apparatus 1 standing in front of the main body housing 2 when the paper sheet is manually placed into the tray 30. The apparatus 1 has a further advantage that the upper unit 3 will not interfere with the first manual medium insertion tray 30 placed in its retracted position in the tray accommodating space 40, when the upper unit 30 is pivoted about the second hinge portion 6. The apparatus 1 has a still further advantage that the lower end portions of the abutting plates 37 when the tray 30 is placed in the retracted position 30 have the larger height dimension than the upper end portions nearer to the pivot axis 35, so that the abutting plates 37 can be easily finger-gripped at the lower end portions to pivot the tray 30 from the retracted position in the tray accommodating space 40 to the operative position. The lower end portions of the abutting plates 37 in the retracted position of the tray 30 correspond to the free or distal end portion of the tray 30.

Referring next to FIGS. 4, 5A, 5B and 6, an image recording apparatus constructed according to a second embodiment of this invention will be described. This image recording apparatus is configured to record an image on a surface of a third recording medium in the form of an optical disk 46 such as a CD-R or a DVD manually placed in a second manual medium insertion tray 45. The image may be a label identifying the optical disk 45, for example.

Figure 4:
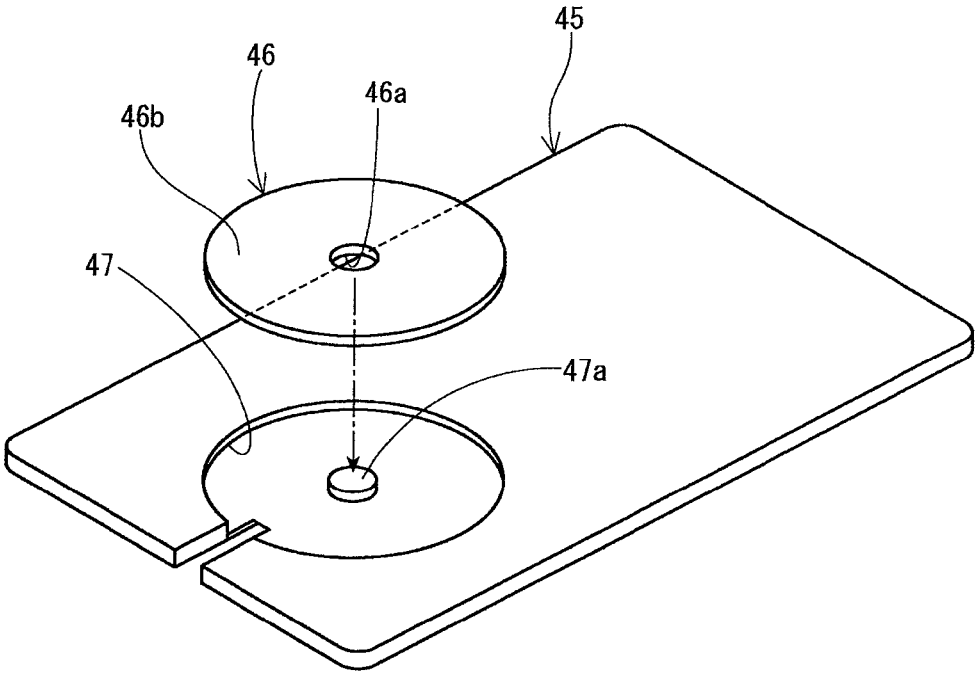
FIG. 4 is an exploded perspective view of a second manual medium insertion tray provided in an image recording apparatus constructed according to a second embodiment of this invention.

The second manual medium insertion tray 45 shown in the schematic perspective view of FIG. 4 is formed of a synthetic resin, and has a circular recess 47 formed in its upper surface such that the circular recess 47 has a diameter substantially equal to the diameter of the optical disk 46, so that the third recording medium in the form of the optical disk 46 can be manually set in the circular hole 47. The tray 45 further has a center boss 46*a* formed in the center of the circular recess 47 such that the center boss 46*a* has a height equal to the depth of the circular recess 47 and is engageable with a center hole 46*a* of the optical disk 46. The optical disk 46 has a label recording area 46*b* on its front surface in which the label identifying the contents of the optical disk 45, for example, is recorded by the image recording device 12. The contents such as images or music are recorded on the back surface of the optical disk 45.

Figure 5A:
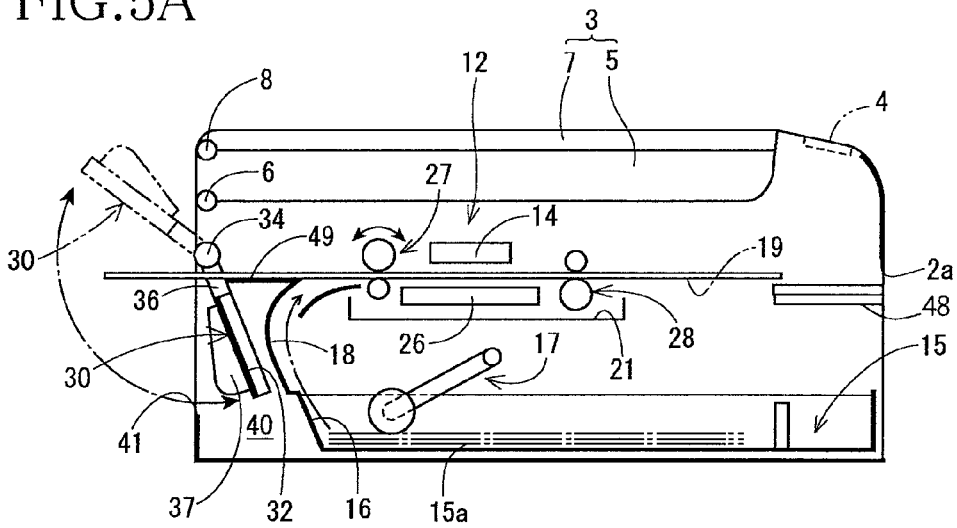
FIGS. 5A and 5B are schematic elevational views of the image recording apparatus of the second embodiment.

As shown in FIG. 5A, a tray transferring device 48 is disposed in a front portion of the main body housing 2 adjacent to the front opening 2*a*. The second manual medium insertion tray 45 manually loaded with the optical disk 46 is manually set in the tray transferring device 48 such that the tray 45 is supported on its widthwise opposite sides by the tray transferring device 48. The tray transferring device 48 is operated to feed the tray 45 together with the optical disk 46, along the feeding path 19 toward and through the image recording device 12.

Figure 6:
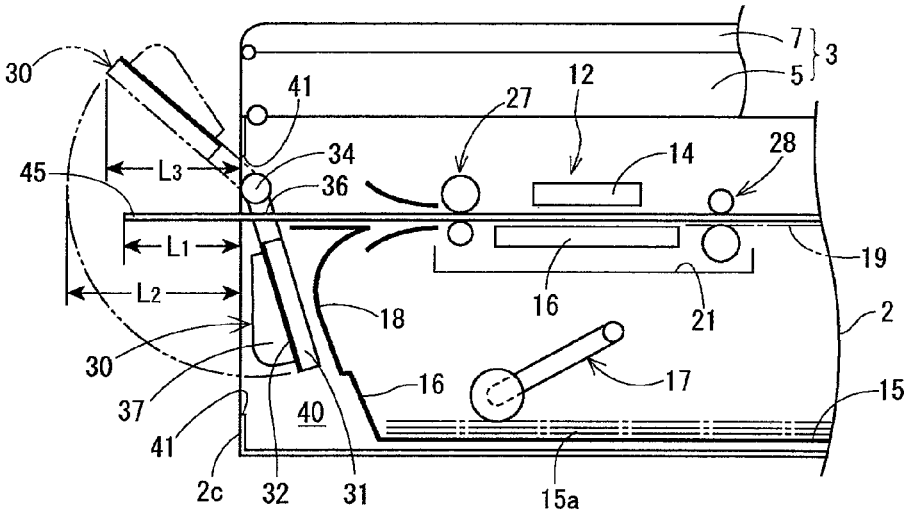
FIG. 6 is a schematic elevational view of the image recording apparatus of the second embodiment, for explaining an operation of the apparatus.

The tray transferring device 48 is placed in a standby position before the second manual medium insertion tray 45 is manually set in the tray transferring device 48. In this standby position, the tray transferring device 48 is held stationary in a front end portion of the main body housing 2 near the front opening 2*a*. When a tray setting command is input through the operator's control panel portion 4, the tray transferring device 48 is moved downwards by a relatively small distance and is then moved horizontally in the direction from the rear opening 41 toward the front opening 2*a* until the end portion of the tray transferring device 48 on the side of the front opening 2*a* is located outside the front opening 2*a*, that is, until the tray transferring device 48 partially projects from the front opening 2*a*. In this tray setting position of the tray transferring device 48 established by generation of the tray setting command, the second manual medium insertion tray 45 manually loaded with the optical disk 46 is manually set in the tray transferring device 48. When a label recording standby command is input through the operator's control panel portion 4, the tray transferring device 48 is moved toward the image recording device 12, and at the same time the two sheet feeding rollers 27 (drive and driven rollers) are vertically spaced apart from each other while the two ejector rollers 28 (drive roller and spur wheel) are vertically spaced apart from each other. Consequently, the tray 45 is inserted and moved between the ejector rollers 28 and between the sheet feeding rollers 27, as indicated in FIG. 6. Then, the sheet feeding rollers 27 are vertically moved toward each other while the ejector rollers 28 are vertically moved toward each other, to nip the tray 45, and the drive rollers of the sheet feeding and ejector rollers 27, 28 are rotated in the direction to further move the tray 45 along the feeding path 19 in the direction from the front opening 2*a* toward the rear opening 41 until the tray 45 partially projects from the main body housing 2 through the rear opening 41 by a predetermined distance L1, as indicated in FIG. 6, that is, until the tray 45 is brought into its label recording standby position. When a label recording command is then input through the operator's control panel portion 4 while the tray is placed in the label recording standby position, the drive rollers are rotated in the direction to intermittently feed the tray 45 in the direction from the rear opening 41 toward the front opening 2*a*, while at the same time the image recording device 12 is operated to record the label in the label recording area 46*b* of the optical disk 46 set in the tray 45. It will be understood that the sheet feeding rollers 27 and ejector rollers 28 function as a second feeding mechanism for feeding the second manual medium insertion tray 45 to and from the label recording standby position. In the specific example of FIG. 6, the tray 45 is fed through the gap space 36 of the first manual medium insertion tray 30 placed in its retracted position before the tray 45 projects from the rear opening 41.

The distance L1 of outward projection of the second manual medium insertion tray 45 from the main body housing 2 through the rear opening 41 is smaller than a distance L2 of outward projection of the first manual medium insertion tray 30 from the main body housing 2 through the rear opening 41 when the tray 30 is placed in its the horizontal posture which is established during a pivotal movement of the tray 30 from the retracted position indicated by the solid line in FIG. 6 to the operative position indicated by the two-dot chain line. The distance L1 is also smaller than a distance L3 of projection of the tray 30 from the rear opening 41 when the tray 30 is placed in its operative position.

In the other aspects, the image recording apparatus according to the second embodiment is identical with the image recording apparatus 1 according to the first embodiment.

The image recording apparatus of the second embodiment has the same advantages as that of the first embodiment, and further has an additional advantage that as long as a spacing distance from the back plate 2*c* of the apparatus to a wall of a room in which the apparatus is installed, or to any object located near the apparatus, is set to be slightly larger than the above-indicated distance L2 of projection of the first manual medium insertion tray 30, the second manual medium insertion tray 45 will not interfere with the room wall or any other object when the tray 45 is brought into the above-indicated label recording standby position prior to the label recording on the optical disk 46.

Figure 5B:
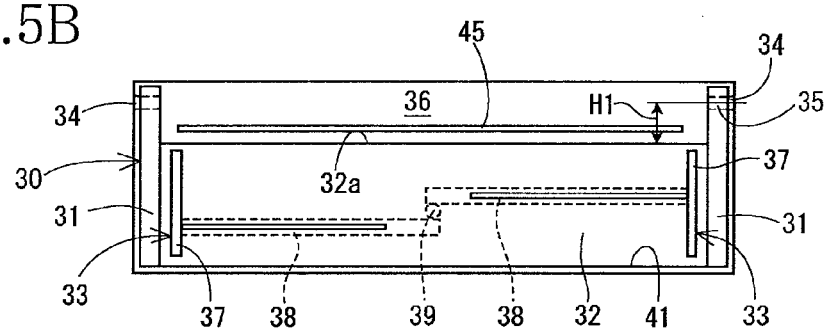

As described above with respect to the first embodiment, and as shown in FIG. 5B, the first manual medium insertion tray 30 has the gap space 36 having the dimension H1 between the pivot axis 35 of the first hinge portion 34 and the end face 32*a* of the sheet support plate 32. This dimension H1 is sufficient to permit the second manual medium insertion tray 45 to move through the gap space 36 when the tray 45 is moved to its label recording standby position. Further, the distance between the pair of arms 31 of the tray 30 is selected to be larger than the width dimension of the tray 45, namely, sufficient to permit the tray 45 to move between the arms 31. While the tray 30 is placed in its operative position in which the sheet support plate 32 is located above the first hinge portion 34, the tray 45 will not interfere with the tray 30 when the tray 45 is brought into its label recording standby position in which the tray 45 projects from the rear opening 41 of the main body housing 2. While the tray 30 is placed in its retracted position in which the sheet support plate 32 is located below the first hinge portion 34, too, the tray 45 will not interfere with tray 30 when the tray 45 is brought into the label recording standby position, since the tray 45 moves through the gap space 36 left between the pair of arms 31 and between the pivot axis 35 and the end face 32*a* of the sheet support plate 32.

In the second embodiment, the first manual medium insertion tray 30 is connected to the main body housing 2 such that the first hinge portion 34 about which the first manual medium insertion tray 30 is pivotable has a higher vertically position than that of the feeding path 19. In a third embodiment of this invention shown in FIG. 7A, the first manual medium insertion tray 30 is connected to the main body housing 2 such that the first hinge portion 34 has substantially the same vertical position as that of the feeding path 19. In a fourth embodiment of the invention shown in FIG. 7B, the first manual medium insertion tray 30 is connected to the main body housing 2 such that the first hinge portion 34 has a lower vertical position than that of the feeding path 19. In these third and fourth embodiments, too, the tray 30 has the gap space 36 having the suitable dimension H1, so that the second manual medium insertion tray 45 is moved through the gap space 36 provided in the tray 30, irrespective of whether the tray 30 is placed in its operative or retracted (inoperative) position, when the tray 45 is moved to its label recording standby position in which the tray 45 projects from the rear plate 2*c* of the main body housing 2.

Figure 7A:
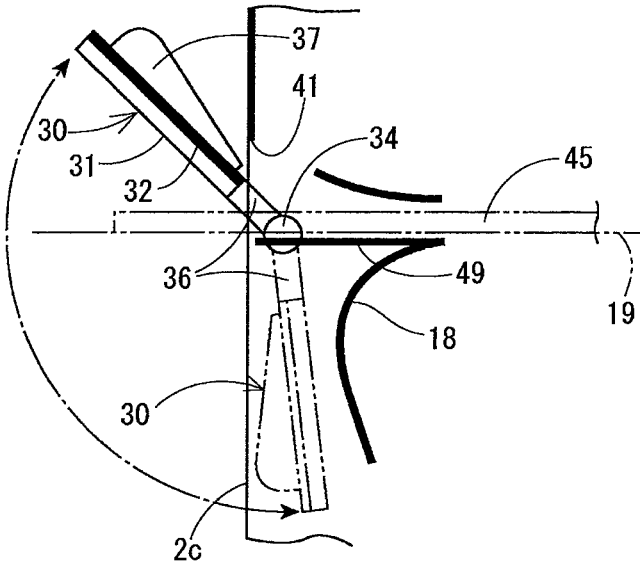
FIG. 7A is a schematic elevational view indicating a vertical position of a hinge portion of a first manual medium insertion tray relative to the main body housing of the apparatus, in an image recording apparatus according to a third embodiment of the invention.
Figure 7B:
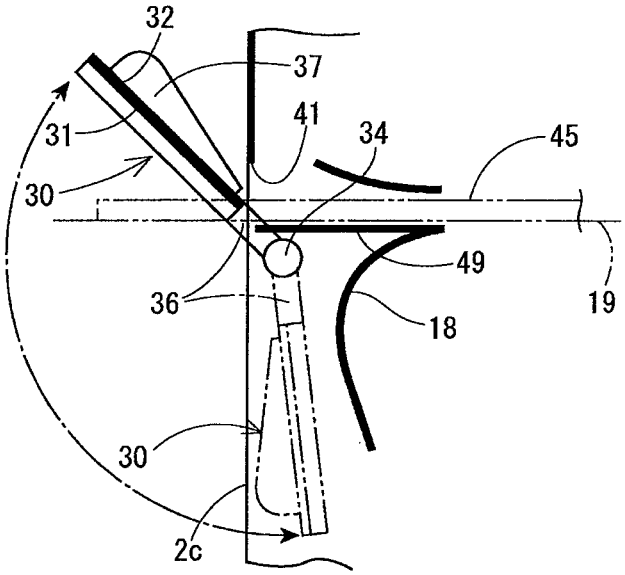
FIG. 7B is a schematic elevational view indicating a vertical position of a hinge portion of a first manual medium insertion tray relative to the main body housing of the apparatus, in an image recording apparatus according to a fourth embodiment of the invention.

In the second, third and fourth embodiments of FIGS. 5A, 7A and 7B, the image recording apparatus is provided with an auxiliary horizontal sheet guiding plate 49 extending from the upper end of the U-turn sheet transfer path 18 toward the rear opening 41, so that the paper sheet fed away from the upwardly inclined sheet support plate 32 of the first manual medium insertion tray 30 placed in the operative position can be smoothly guided to the pair of sheet feeding rollers 27. However, this auxiliary horizontal sheet guiding plate 49 is not essential.

Referring to FIGS. 8-11, an image recording apparatus constructed according to a fifth embodiment of this invention will be described.

Figure 8:
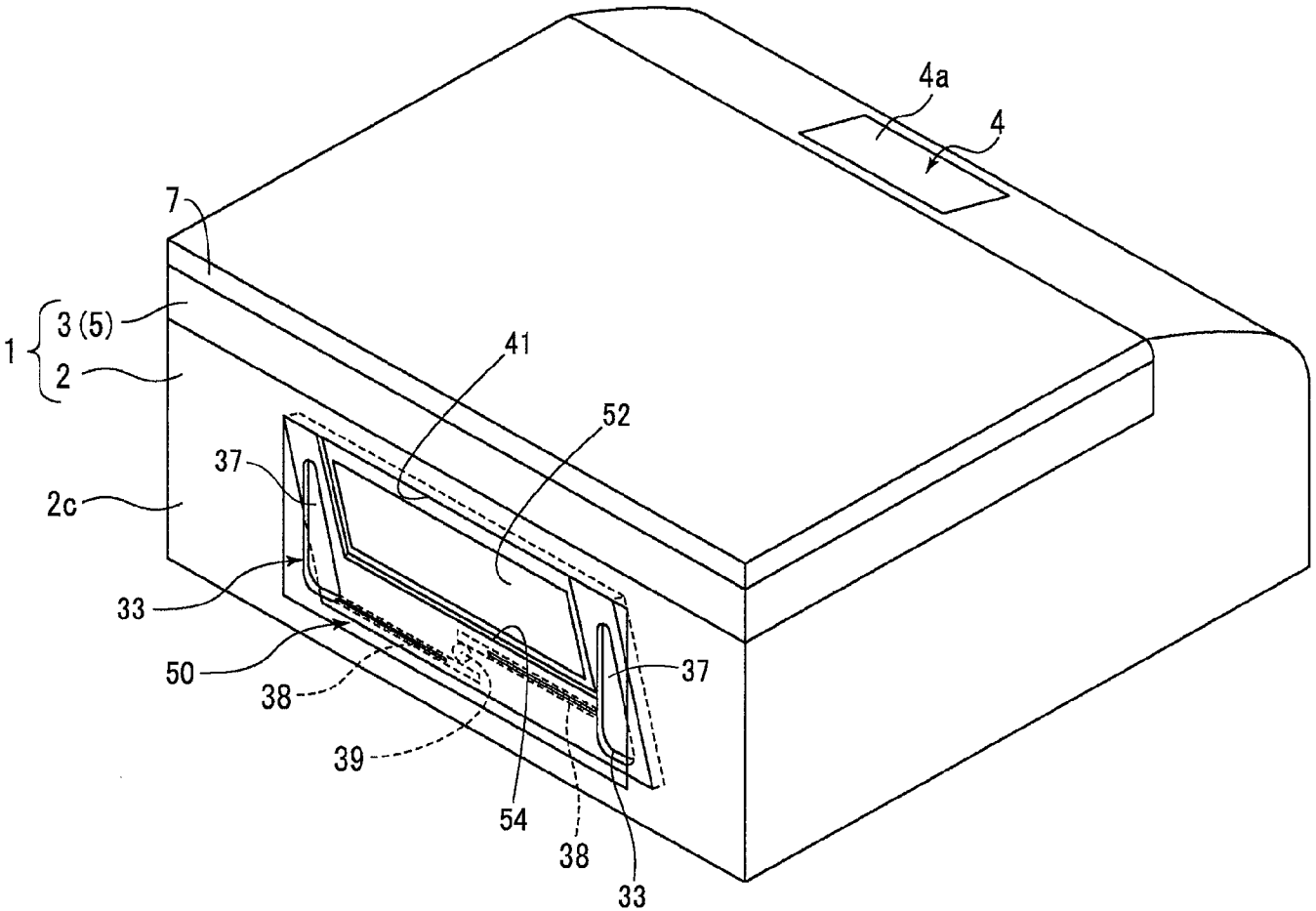
FIG. 8 is a rear-side perspective view of an image recording apparatus constructed according to a fifth embodiment of this invention.

As shown in FIG. 8, the image recording apparatus of the fifth embodiment is provided with a first manual medium insertion tray 50 including a sheet support plate 51 connecting the pair of arms 31, and a gate member 52 pivotally connected to the sheet support plate 51. The side guide device 33 described above with respect to the preceding embodiments is slidably disposed on the sheet support plate 51, and the gate member 52 is disposed between the two abutting plates 37 of the side guide device 33.

Figure 9A:
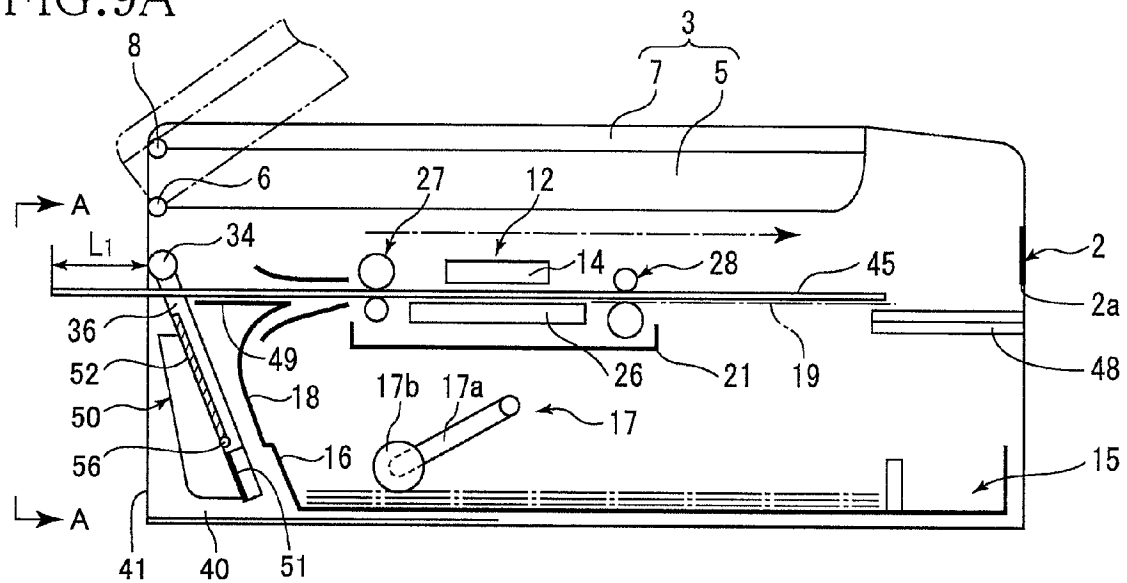
Figure 9B:
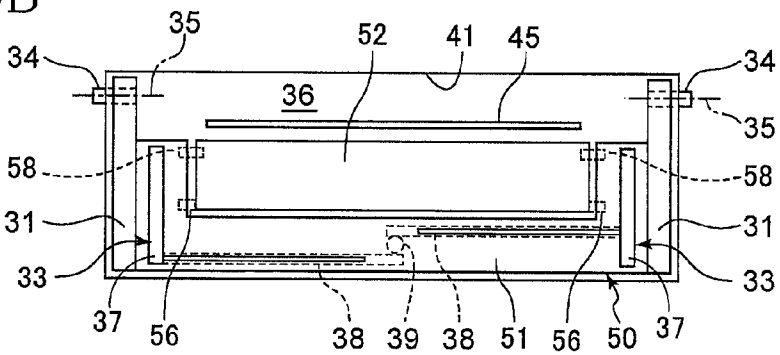
FIG. 9B is an elevational view of the same image recording apparatus taken along line A-A of FIG. 9A.
Figure 10:
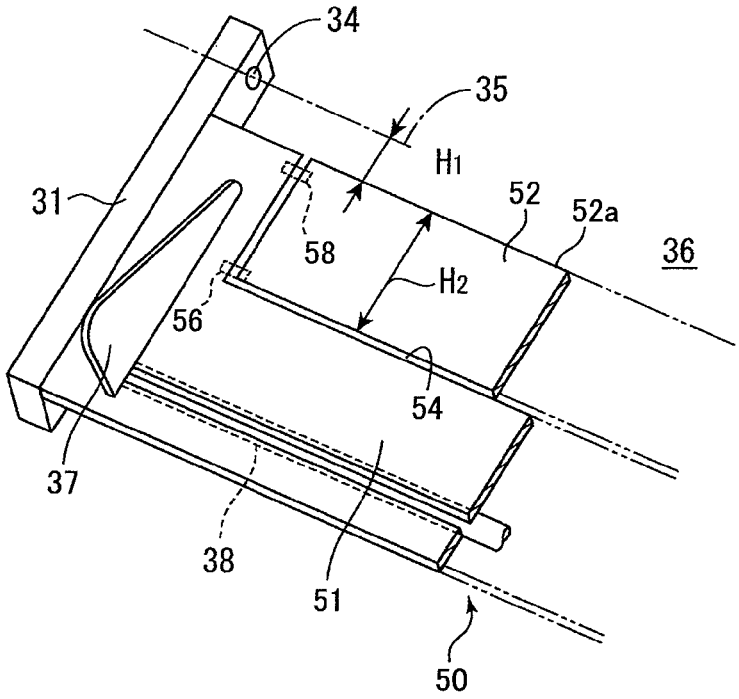
FIG. 10 is a partly cut-away perspective view of a first manual medium insertion tray provided in the image recording apparatus of the fifth embodiment.
Figure 11:
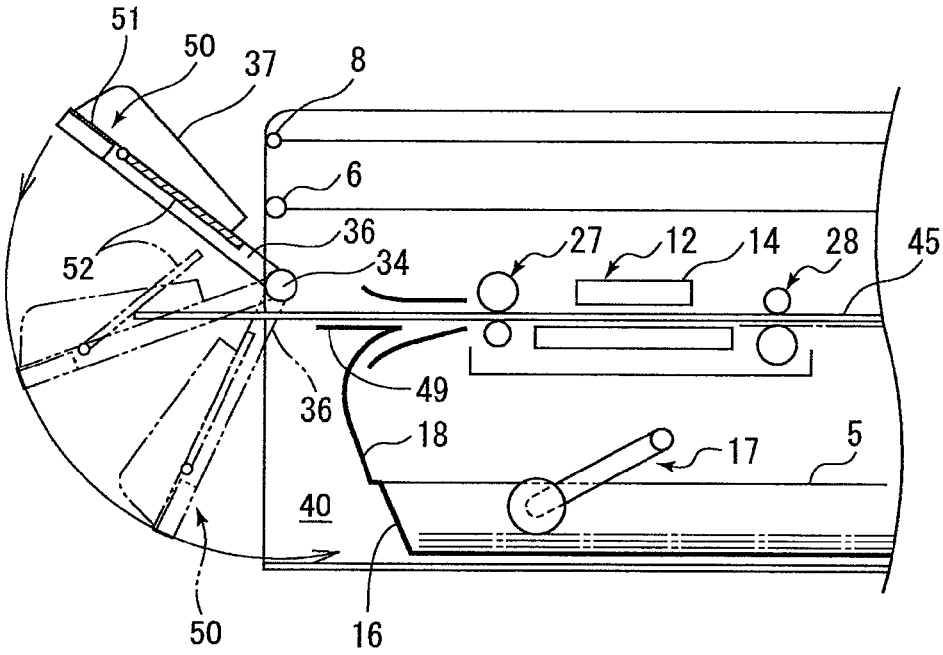
FIG. 11 is a schematic elevational view of the image recording apparatus of the fifth embodiment, for explaining an operation of the apparatus.

As shown in FIGS. 9-11, the gate member 52 is located between the sheet support plate 51 and the first hinge portion 34. The second recording medium is placed on the sheet support plate 51 and the gate member 52 while the first manual medium insertion tray 50 is placed in its operative position (indicated by solid line in FIG. 11) in which the sheet support plate 51 is located above the first hinge portion 34. The sheet support plate 51 is fixed to the free end portion of the arms 31 remote from the first hinge portion 34. This sheet support plate 51 has a cutout 54 formed in its portion located on the side of the first hinge portion 34, and the gate member 52 is pivotally connected to the sheet support plate 51 such that the gate member 52 is disposed within the cutout 54 and is pivotable about a pivot shaft portion in the form of pivot shafts 56 provided at its proximal end portion remote from the first hinge portion 34. The sheet support plate 51 is fixed to the arms 31 such that the gap space 36 having the dimension H1 indicated in FIG. 10 is left between the pivot axis 35 of the first hinge portion 34 and an end face 52*a* of the gate member 52 on the side of the first hinge portion 34. The gate member 52 is biased by a suitable biasing means such a torsion spring, for normally holding the sheet support surface of the gate member 52 in flush with the sheet support surface of the sheet support plate 51, that is, for normally holding the gate member 52 in a sheet support position in which the gate member 52 is in flush with the sheet support plate 51 when the tray 50 is placed in the operative position.

The gate member 52 is provided on its back side with stop members 58, which prevents the gate member 52 from pivoting by the biasing means from the operative position in which the gate member 52 is flush with the sheet support plate 51. The gate member 53 and the cutout 54 have dimensions in the direction of the pivot axis of the pivot shafts 56, which dimensions are larger than the corresponding dimension of the second manual medium insertion tray 45.

The above-described dimension H1 (indicated in FIG. 10) of the gap space 36 between the pivot axis 35 of the first hinge portion 34 and the end face 52*a* of the gate member 52 is selected to be large enough to permit the second manual medium insertion tray 45 to move through the label recording standby position. The first manual insertion tray 50 may be manually pivoted by the user of the apparatus, from the operative position (indicated by solid line in FIG. 11) to the retracted position (indicated in two-dot chain line) in the tray accommodating space 40, with the posture of the tray 50 changing from the upwardly inclined posture to the generally downwardly extending posture, while the second manual insertion tray 45 is placed in its label recording standby position, with its end portion extending through the gap space 36. In this case, the first manual medium insertion tray 50 in its pivotal motion comes into abutting contact with the second manual medium insertion tray 45 placed in the label recording standby position extending through the gap space 36. To hold the second manual medium insertion tray 45 in the label recording standby position, for permitting the intended label recording operation subsequently performed on the optical disk 46 set in the tray 45, the first manual medium insertion tray 50 is provided with the gate member 52 which is pivotable in the counterclockwise direction (as seen in FIG. 11) against a biasing action of the biasing means, in abutting contact on its back surface with the end of the tray 50 in its pivotal motion in the clockwise direction from the operative position toward the retracted position. For assuring the abutting contact of the gate member 52 on its back surface with the end of the tray 45, a dimension H2 (also indicated in FIG. 10) of the gate member 52 between a pivot axis of the pivot shafts 56 and the end face 52*a* is suitably selected, and the dimension (length) of the gate member 52 in the direction of extension of the pivot axis is selected to be larger than the corresponding dimension of the tray 45. Thus, the gate member 52 permits the second manual medium insertion tray 45 to remain in the label recording standby position even if the first manual medium insertion tray 30 is pivoted from the operative position to the retracted position while the tray 45 is placed in the label recording standby position.

The first manual medium insertion tray 50 is inhibited from manually pivoting in the clockwise direction (as seen in FIG. 11) from the retracted position in the tray accommodating space 40 toward the operative position. In the retracted position of the tray 50 in the tray accommodating space 40, the gate member 52 is held in flush with the sheet support plate 51 by the biasing means and the stop members 58, and is prevented from pivoting in the counterclockwise direction (as seen in FIG. 11) relative to the body of the tray 50, extending outwardly from the rear opening 41.

Figure 12A:
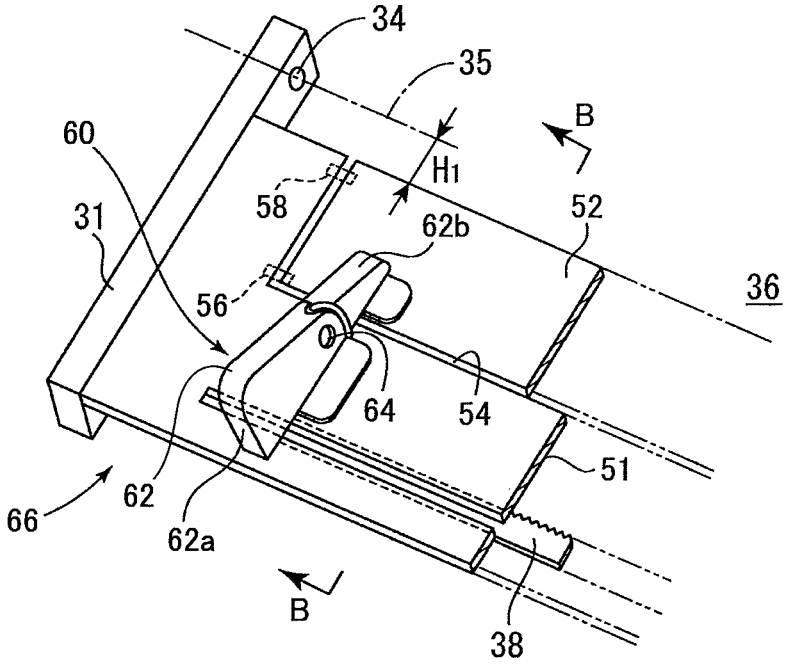
Figure 12B:
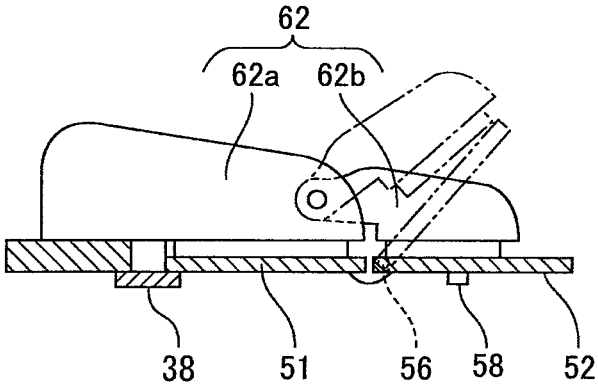
FIG. 12B is a cross sectional view of the first manual medium insertion tray of the sixth embodiment of FIG. 12A taken along line B-B of FIG. 12A.

Referring next to FIGS. 12A and 12B, an image recording apparatus constructed according to a sixth embodiment of this invention will be described. This image recording apparatus is provided with a first guide device 60 includes a pair of abutting plates 62, one of which is shown in FIG. 12A. Each abutting plate 62 has a main body portion 62*a* fixed to the sheet support plate 51, and a pivot portion 62*b* connected to the main body portion 62*a* pivotally about a pivot pin 64 in the vertical direction. While the two abutting plates 62 are located relatively close to each other within the length of the gate member 52, the gate member 52 comes into abutting contact with the pivot member 62*b* when the gate member 52 is pivoted about the pivots shafts 56 in the counterclockwise direction (as seen in FIG. 12B) toward the pivot member 62*b*. With a further counterclockwise pivotal motion of the gate member 52, the pivot member 62*b* is pivoted by the gate member 52 in the counterclockwise direction about the pivot pin 64 relative to the main body portion 62*a*, as shown in FIG. 12B. Namely, when the gate member 52 is pivoted in the counterclockwise direction in abutting contact with the end of the second manual medium insertion tray 45, as shown in FIG. 11, the pivot portion 62*b* of the abutting plate 62 is also pivoted in the counterclockwise direction by the pivoting gate member 52. Thus, the pivot portion 62*b* of each abutting plate 62 permits the first manual medium insertion tray 66 to be pivoted from its operative position to the retracted position even while the two abutting plates 66 are located within the length of the gate member 52.

While the preferred embodiments of this invention have been described, it is to be understood that the present invention may be embodied with various changes and modifications, which may occur to those skilled in the art, without departing from the spirit and scope of the invention defined in the appended claims.

For example, the first manual medium insertion trays 30, 50 may be provided with an auxiliary sheet support plate linearly movable or foldable relative to the sheet support plate 32, 51, for supporting the trailing end portion of the second recording medium.

While the image recording apparatus 1 constructed according to the illustrated embodiments is of a multi-function type, the principle of the present invention is equally applicable to an image recording apparatus of a single-function type.

In the illustrated embodiments, the image recording apparatus 1 includes the upper unit 3 incorporating the image reading device 5. However, the image recording apparatus including the first manual medium insertion tray 30 with or without the second manual medium insertion tray 45 according to the present invention need not incorporate the image reading device 5.

What is claimed is:

1. An image recording apparatus comprising:

a main body housing having a front opening formed on a front side thereof, and a tray accommodating space formed in a rear end portion thereof;

an image recording device disposed in the main body housing and configured to record images on recording media;

a feeding path which is formed in the main body housing and along which each of the recording media is fed through the image recording device;

the main body housing being configured to permit a sheet supply cassette to be disposed below the image recording device such that the sheet supply cassette is movable into and out of the main body housing through the front opening, the sheet supply cassette being configured to accommodate a stack of sheets as a first recording medium;

a first feeding mechanism configured to feed the sheets of the first recording medium one after another from the sheet supply cassette;

a U-turn sheet transfer path formed so as to extend generally upwards from an end of the sheet supply cassette on a rear side of the main body housing, to transfer the sheets of the first recording medium fed by the first feeding mechanism, to the feeding path along which the sheets are fed through the image recording device and ejected through the front opening of the main body housing, by the first feeding mechanism;

a first hinge portion disposed at the rear end portion of the main body housing;

a first manual medium insertion tray manually loaded with a second recording medium and connected to the rear end portion of the main body housing such that the first manual medium insertion tray is pivotable in a vertical direction about a horizontally extending pivot axis of the first hinge portion, between an operative position thereof in which the second recording medium is fed to the feeding path, and a retracted position thereof in which the second recording medium is not fed to the feeding path, the first manual medium insertion tray placed in the operative position having an upwardly inclined posture extending outwardly from the rear end portion of the main body housing, while the first manual medium insertion tray placed in the retracted position having a posture extending generally downwards in the tray accommodating space formed within the main body housing and on a rear side of the U-turn sheet transfer path, the main body housing further having on its rear side a rear opening through which the first manual medium insertion tray is pivotable to the refracted position; and a second feeding mechanism configured to feed, along the feeding path and under the image recording device, a second manual medium insertion tray manually loaded with a third recording medium, after the second manual medium insertion tray is introduced into the main body housing through the front opening of the main body housing, the second feeding mechanism being operated to feed the second manual medium insertion tray such that the second manual medium insertion tray partially outwardly projects from the main body housing through the rear opening by a predetermined distance that is smaller than a maximum distance of outward projection of the first manual medium insertion tray from the main body housing through the rear opening during a pivotal motion of the first manual medium insertion tray of the first manual medium insertion tray between the operative and retracted positions, wherein the first manual medium insertion tray has a gap space through which the second manual medium insertion tray is fed to partially project from the rear opening of the main body housing.

2. The image forming apparatus according to claim 1, further comprising:

a second hinge portion disposed at the rear end portion of the main body housing and located above the first hinge portion; and an image reading device disposed on the main body housing such that the image reading device is pivotable in the vertical direction about a horizontally extending pivot axis of the second hinge portion.

3. The image recording apparatus according to claim 1, wherein the first manual medium insertion tray includes a side guide device having a pair of abutting plates for abutting contact with respective opposite side edges of the second recording medium inserted in the first manual medium insertion tray placed in the operative position, for guiding the second recording medium in a direction of feeding of the recording medium, each of the abutting plates having a larger height dimension in an end portion thereof remote from the first hinge portion than in the other end portion near the first hinge portion.

4. The image recording device according to claim 1, wherein the predetermined distance of outward projection of the second manual medium insertion tray from the main body housing through the rear opening is smaller than a distance of projection of the first manual medium insertion tray from the rear opening when the first manual medium insertion tray is placed in the operative position.

5. The image recording apparatus according to claim 1, wherein the second manual medium insertion tray is fed to partially project from the main body housing through the rear opening by the predetermined distance irrespective of whether the first manual medium insertion tray is placed in the operative position or the retracted position.

6. The image recording apparatus according to claim 5, wherein the first hinge portion about which the first manual medium insertion tray is pivotable has a higher vertical position than that of the feeding path, and the second manual medium insertion tray is fed to partially project from the rear opening of the main body housing when the first manual medium insertion tray is placed in the refracted position.

7. The image recording apparatus according to claim 5, wherein the first hinge portion about which the first manual medium insertion tray is pivotable has substantially the same vertical position as that of the feeding path, and the second manual medium insertion tray is fed to partially project from the rear opening of the main body housing when the first manual medium insertion tray is placed in the operative and refracted positions.

8. The image recording apparatus according to claim 5, wherein the first hinge portion about which the first manual medium insertion tray is pivotable has a lower vertical position than that of the feeding path, and the second manual medium insertion tray is fed to partially project from the rear opening of the main body housing when the first manual medium insertion tray is placed in the operative position.

9. An image recording apparatus comprising:

a main body housing having a front opening formed on a front side thereof, and a tray accommodating space formed in a rear end portion thereof;

an image recording device disposed in the main body housing and configured to record images on recording media;

a feeding path which is formed in the main body housing and along which each of the recording media is fed through the image recording device;

the main body housing being configured to permit a sheet supply cassette to be disposed below the image recording device such that the sheet supply cassette is movable into and out of the main body housing through the front opening, the sheet supply cassette being configured to accommodate a stack of sheets as a first recording medium;

a first feeding mechanism configured to feed the sheets of the first recording medium one after another from the sheet supply cassette;

a U-turn sheet transfer path formed so as to extend generally upwards from an end of the sheet supply cassette on a rear side of the main body housing, to transfer the sheets of the first recording medium fed by the first feeding mechanism, to the feeding path along which the sheets are fed through the image recording device and ejected through the front opening of the main body housing, by the first feeding mechanism;

a first hinge portion disposed at the rear end portion of the main body housing; and a first manual medium insertion tray manually loaded with a second recording medium and connected to the rear end portion of the main body housing such that the first manual medium insertion tray is pivotable in a vertical direction about a horizontally extending pivot axis of the first hinge portion, between an operative position thereof in which the second recording medium is fed to the feeding path, and a retracted position thereof in which the second recording medium is not fed to the feeding path, wherein the first manual medium insertion tray placed in the operative position having an upwardly inclined posture extending outwardly from the rear end portion of the main body housing, while the first manual medium insertion tray placed in the retracted position having a posture extending generally downwards in the tray accommodating space formed within the main body housing and on a rear side of the U-turn sheet transfer path, the main body housing further having on its rear side a rear opening through which the first manual medium insertion tray is pivotable to the refracted position, a second feeding mechanism configured to feed, along the feeding path and under the image recording device, a second manual medium insertion tray manually loaded with a third recording medium, after the second manual medium insertion tray is introduced into the main body housing through the from opening of the main body housing, the second feeding mechanism being operated to feed the second manual medium insertion tray such that the second manual medium insertion tray partially outwardly projects from the main body housing through the rear opening by a predetermined distance that is smaller than a maximum distance of outward projection of the first manual medium insertion tray from the main body housing through the rear opening during a pivotal motion of the first manual medium insertion tray of the first manual medium insertion tray between the operative and retracted positions, the second manual medium insertion tray is fed to partially project from the main body housing through the rear opening by the predetermined distance irrespective of whether the first manual medium insertion tray is placed in the operative position or the retracted position, and the first manual medium insertion tray includes a sheet support plate on which the second recording medium is placed, and a gap space is formed between an end face of the sheet support plate on the side of the first hinge portion, and the horizontally extending pivot axis of the first hinge portion about which the first manual medium insertion tray is pivotable, the second manual medium insertion tray being fed to partially project from the rear opening of the main body housing through the gap space.

10. An image recording apparatus comprising:

a main body housing having a front opening formed on a front side thereof, and a tray accommodating space formed in a rear end portion thereof;

an image recording device disposed in the main body housing and configured to record images on recording media;

a feeding path which is formed in the main body housing and along which each of the recording media is fed through the image recording device;

the main body housing being configured to permit a sheet supply cassette to be disposed below the image recording device such that the sheet supply cassette is movable into and out of the main body housing through the front opening, the sheet supply cassette being configured to accommodate a stack of sheets as a first recording medium;

a first feeding mechanism configured to feed the sheets of the first recording medium one after another from the sheet supply cassette;

a U-turn sheet transfer path formed so as to extend generally upwards from an end of the sheet supply cassette on a rear side of the main body housing, to transfer the sheets of the first recording medium fed by the first feeding mechanism, to the feeding path along which the sheets are fed through the image recording device and ejected through the front opening of the main body housing, by the first feeding mechanism;

a first hinge portion disposed at the rear end portion of the main body housing; and a first manual medium insertion tray manually loaded with a second recording medium and connected to the rear end portion of the main body housing such that the first manual medium insertion tray is pivotable in a vertical direction about a horizontally extending pivot axis of the first hinge portion, between an operative position thereof in which the second recording medium is fed to the feeding path, and a retracted position thereof in which the second recording medium is not fed to the feeding path, wherein the first manual medium insertion tray placed in the operative position having an upwardly inclined posture extending outwardly from the rear end portion of the main body housing, while the first manual medium insertion tray placed in the retracted position having a posture extending generally downwards in the tray accommodating space formed within the main body housing and on a rear side of the U-turn sheet transfer path, the main body housing further having on its rear side a rear opening through which the first manual medium insertion tray is pivotable to the refracted position, the main body housing is configured to permit a second manual medium insertion tray manually loaded with a third recording medium, to be fed along the feeding path, after the second manual medium insertion tray is introduced into the main body housing through the front opening of the main body housing, the first manual medium insertion tray including a sheet support plate on which the second recording medium is placed, and a gate member which is disposed adjacent to the sheet support plate such that the gate member is pivotable to a sheet support position in which the gate member is held in flush with the sheet support member, the gate member being pivotable from the sheet support position, in abutting contact with the second manual medium insertion tray partially projecting from the rear opening of the main body housing, when the first manual medium insertion tray is pivoted from the operative position toward the retracted position.

11. The image recording apparatus according to claim 10, wherein the gate member includes a pivot portion which is supported by the first manual medium insertion tray and about which the gate member is pivotable, the pivot portion being located at a proximal end portion of the gate member remote from the first hinge portion.

12. The image recording apparatus according to claim 10, further comprising a second feeding mechanism configured to feed, along the feeding path and under the image recording device, a second manual medium insertion tray manually loaded with a third recoding medium, after the second manual medium insertion tray is introduced into the main body housing through the front opening of the main body housing, the second feeding mechanism being operated to feed the second manual medium insertion tray such that the second manual medium insertion tray partially projects from the main body housing through the rear opening by a predetermined distance that is smaller than a maximum distance of outward projection of the first manual medium insertion tray through the rear opening from the main body during a pivotal motion of the first manual medium insertion tray from the retracted position to the operative position.

13. The image recording apparatus according to claim 10, further comprising a second hinge portion disposed at the rear end portion of the main body housing and located above the first hinge portion, and an image reading device disposed on the main body housing such that the image reading device is pivotable in the vertical direction about the horizontally extending axis of the second hinge portion.

14. The image recording apparatus according to claim 10, wherein the first manual medium insertion tray includes a side guide device having a pair of abutting plates for abutting contact with respective opposite side edges of the second recording medium inserted in the first manual medium insertion tray placed in the operative position, for guiding the second recording medium in the direction of feeding of the second recording medium, each of the abutting plates having a larger height dimension in an end portion thereof remote from the first hinge portion than in the other end portion near the first hinge portion, the abutting plates being pivoted when the gate member is pivoted in abutting contact with the second manual medium insertion tray during a pivotal motion of the first manual medium insertion tray from the operative position toward the refracted position.

15. The image recording apparatus according to claim 10, wherein each of the abutting plates includes a main body portion fixed to the sheet support member, and a pivot portion pivotally connected to the main body portion such that the pivot portion is pivotable relative to the main body portion in abutting contact with the gate member during the pivotal motion of the first manual medium insertion tray from the operative position toward the retracted position.

16. The image recording apparatus according to claim 10, wherein the first hinge portion has a higher vertical position than that of the feeding path, and the first manual medium insertion tray has a gap space through which the second medium insertion tray partially projects when the first manual medium insertion tray is placed in the refracted position.

17. The image recording apparatus according to claim 10, wherein a gap space is formed between an end face of the gate member on the side of the first hinge portion, and an axis of pivot of the first hinge portion about which the first manual medium insertion tray is pivotable, the second manual medium insertion tray being fed to partially project from the rear opening of the main body housing through the gap space.

* * * * *